US008046870B2

(12) United States Patent
Tanasescu

(10) Patent No.: US 8,046,870 B2
(45) Date of Patent: Nov. 1, 2011

(54) NOZZLE

(76) Inventor: Ovidiu C. Tanasescu, Sundbyberg (SE)

( * ) Notice: Subject to any disclaimer, the term of this patent is extended or adjusted under 35 U.S.C. 154(b) by 420 days.

(21) Appl. No.: 12/279,223

(22) PCT Filed: Feb. 13, 2007

(86) PCT No.: PCT/SE2007/000126

§ 371 (c)(1),
(2), (4) Date: Aug. 13, 2008

(87) PCT Pub. No.: WO2007/094706

PCT Pub. Date: Aug. 23, 2007

(65) Prior Publication Data

US 2009/0064451 A1 Mar. 12, 2009

(30) Foreign Application Priority Data

Feb. 14, 2006 (SE) ..... 0600314

(51) Int. Cl.

| | |
|---|---|
| ***A47L 5/10*** | (2006.01) |
| ***A47L 5/26*** | (2006.01) |
| ***A47L 5/00*** | (2006.01) |
| ***A47L 9/06*** | (2006.01) |

(52) U.S. Cl. ..... 15/385; 15/401

(58) Field of Classification Search ..... 15/385, 15/401

See application file for complete search history.

(56) References Cited

U.S. PATENT DOCUMENTS

| | | | | |
|---|---|---|---|---|
| 2,609,555 | A * | 9/1952 | Anderson | 15/49.1 |
| 2,999,258 | A * | 9/1961 | Berberian | 15/50.1 |
| 3,624,668 | A * | 11/1971 | Krause | 15/385 |
| 3,813,726 | A * | 6/1974 | Kowalewski | 15/385 |
| 4,692,959 | A * | 9/1987 | Monson | 15/385 |
| 6,643,894 | B1 * | 11/2003 | Dell | 15/385 |

FOREIGN PATENT DOCUMENTS

| | | |
|---|---|---|
| SE | 516943 | 3/2002 |

OTHER PUBLICATIONS

International Search Report Dated May 11, 2007 in PCT/SE2007/000126.

* cited by examiner

*Primary Examiner* — Bryan R Muller
(74) *Attorney, Agent, or Firm* — Young & Thompson

(57) ABSTRACT

A nozzle intended to be connected to a suction source, such as a vacuum cleaner/wet vacuum cleaner, whereby the nozzle includes at least one suction aperture which communicates with the suction source, and a gathering unit disposed close to each suction aperture, each gathering unit including a surface treatment element. Distinguishing features of the nozzle are that each gathering unit has a peripheral surface and a front surface which faces towards the running surface, the transition between the peripheral surface and the front surface is rounded, each gathering unit is provided with a scraper unit which is U-shaped in cross-section and constitutes a surface treatment element, and that the open side of the scraper unit is oriented along the front surface of the gathering unit.

16 Claims, 6 Drawing Sheets

NOZZLE

TECHNICAL FIELD OF THE INVENTION

The present invention relates to a nozzle intended to be connected to a suction source such as a vacuum cleaner/wet vacuum cleaner, whereby the nozzle comprises at least one suction aperture which communicates with the suction source, and a gathering unit is disposed close to each suction aperture.

STATE OF THE ART

A nozzle known from SE 516943 for a suction source such as a vacuum cleaner or a wet vacuum cleaner comprises at least one suction aperture connected to the suction source. A rotatable disc-shaped gathering unit is disposed about each suction aperture and defines a restricted space round each suction aperture. Each gathering unit comprises at least one surface treatment element, preferably in the form of a brush or a scraper.

OBJECTS AND FEATURES OF THE INVENTION

A primary object of the present invention is to propose a nozzle of the kind defined in the introduction which results in a generally improved cleaning capacity.

A further object of the present invention is that the nozzle should more easily cope with the transition between a hard floor and a carpet lying on the hard floor.

Another object of the present invention is that the nozzle should be effective on both hard floors and soft carpets.

At least the primary object of the present invention is achieved by a nozzle provided with the features indicated in the independent claim 1. Preferred embodiments of the invention are defined in the dependent claims.

BRIEF DESCRIPTION OF THE DRAWINGS

Embodiments of the invention are described below with reference to the attached drawings, in which.

DETAILED DESCRIPTION OF PREFERRED EMBODIMENTS OF THE INVENTION

Figure 1:
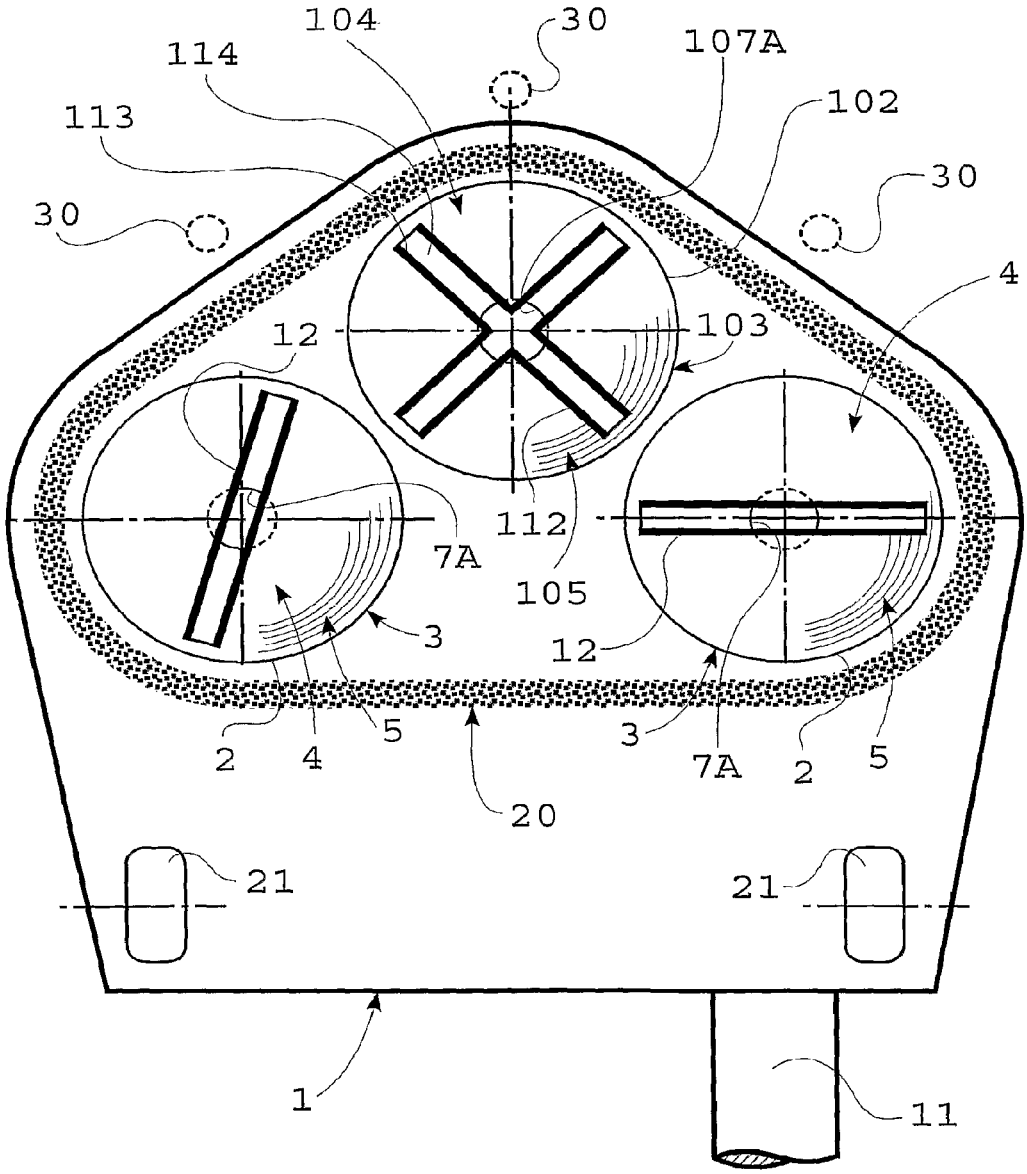
FIG. 1 depicts a plan view of the underside of a nozzle according to the present invention.
Figure 2:
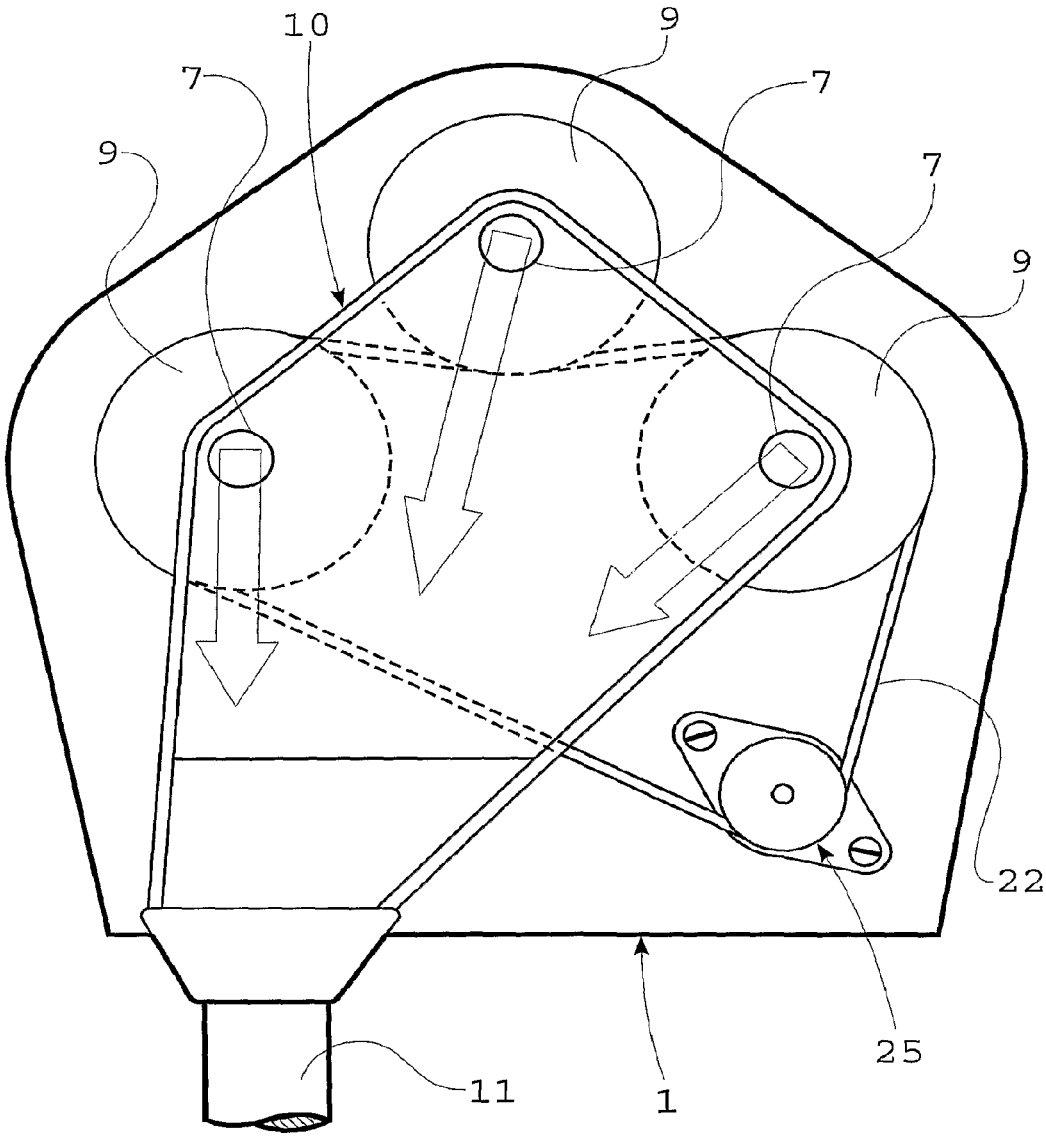
FIG. 2 depicts a plan view from above of the nozzle according to FIG. 1.
Figure 3:
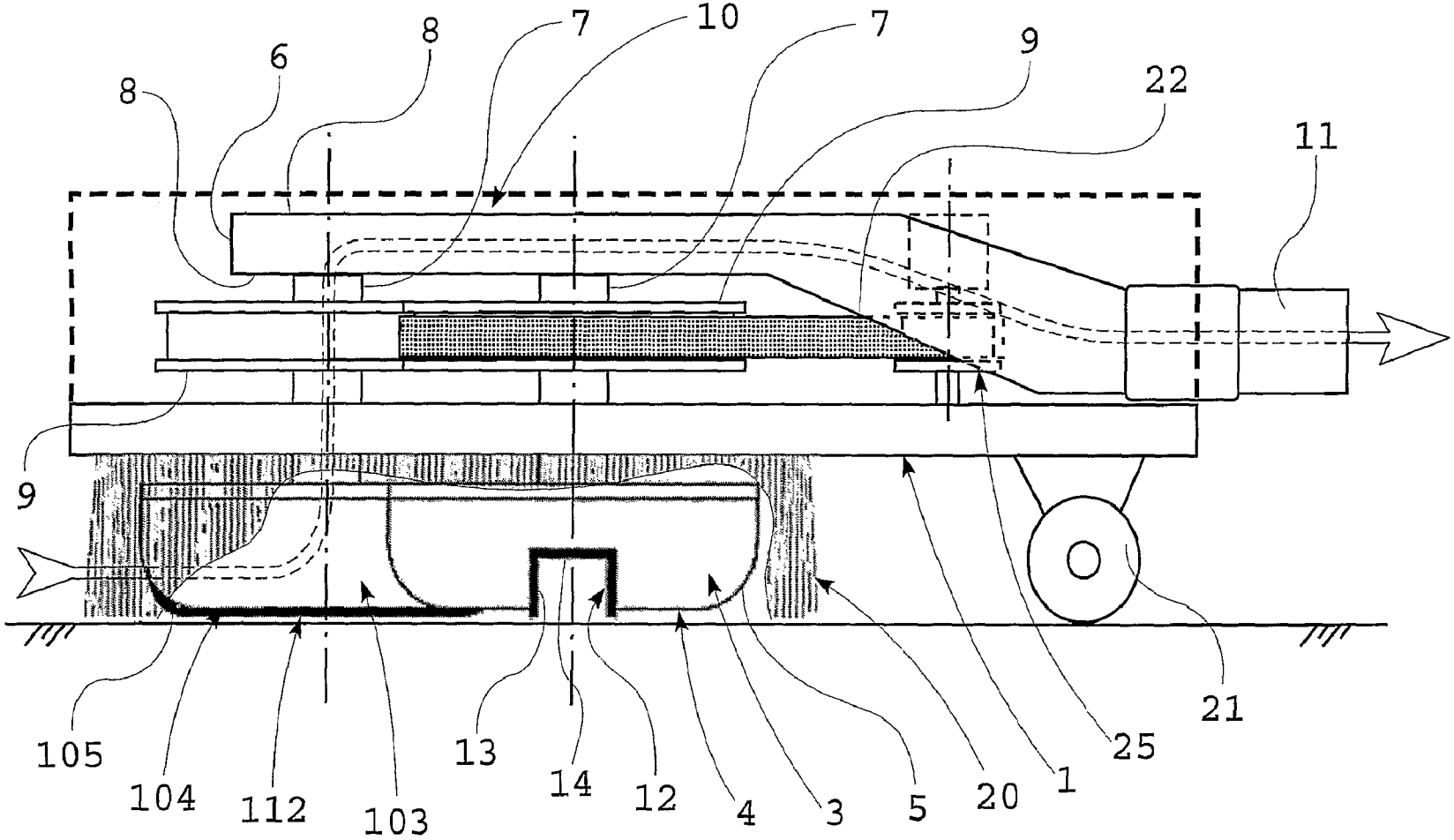
FIG. 3 depicts a side view of the nozzle according to FIG. 1.

The nozzle depicted in FIGS. 1-3 comprises a plate 1 which serves as a base for the nozzle. In the embodiment depicted, three gathering units 3; 103 of generally cylindrical shape are mounted on the plate 1. The configuration of the middle gathering unit 103 is somewhat different from that of the two lateral gathering units 3. This is the reason for using different reference numerals. What happens in practice, however, is that a nozzle according to the present invention is provided with a single type of gathering unit, i.e. the mixed arrangement depicted in FIG. 1 is merely to illustrate two different types of gathering units.

As may be seen most clearly in FIG. 3, the transition 5; 105 between the peripheral surface 3; 103 of the gathering units 2; 102 and a front surface 4; 104 is gently rounded. The front surface 4; 104 faces towards the running surface on which the nozzle is placed. In side view, the gathering units 3; 103 are shell-like. The significance of this configuration will be explained below. The gathering units 3; 103 are preferably made of plastic material.

Each gathering unit 3; 103 is fitted firmly to a pipe 7 which is supported for rotation in the plate 1. The pipe 7 extends through the gathering unit 3 to the area of the front surface 4; 104 of the gathering unit 3; 103, i.e. the surface which faces towards the running surface on which the nozzle is placed. As may be seen most clearly in FIG. 3, the pipes have an extent above the plate 1, whereby a belt pulley 9 is fitted firmly to each pipe 7. The upper ends of the pipes 7 are connected to a suction chamber 10 provided with an outlet pipe 11 to which a vacuum cleaner pipe or a wet vacuum cleaner pipe can be connected in a conventional manner. The upper ends of the pipes 7 are supported for rotation in the suction chamber 10, which comprises two discs 8 which are situated at a distance from one another and are mutually connected to sidewalls 6.

In the embodiment depicted in FIGS. 1-3, each gathering unit 3; 103 is provided with a surface treatment element in the form of a scraper unit 12; 112. Thus the gathering units 3 situated furthest to the left and furthest to the right respectively in FIG. 1 are each provided with a scraper unit 12 with a U-shaped cross-section, each scraper unit 12 having two mutually parallel rectilinear walls 13 situated at a certain distance from one another. A bottom 14 of each scraper unit 12 connects the walls 13 with one another, thereby defining straight channels with open ends in the region of the periphery of each gathering unit 3. An alternatively configured scraper unit 112 is also depicted in FIG. 1 and is associated with a middle gathering unit 3. The alternatively configured scraper unit 112 is generally X-shaped in plan view. In principle, the alternatively configured scraper unit 112 comprises two crosslaid scraper units 12 which in plan view form a right angle with one another. The alternatively configured scraper unit 112 comprises four "fingers", each of which has parallel walls 113 and a bottom 114 connecting the walls 113.

Each of the scraper units 12; 112 is accommodated in an associated gathering unit 3; 103 whereby the free edges of the walls 13; 113 protrude somewhat beyond the surface 4; 104 of the gathering unit 3; 103 which faces towards the floor.

The respective pipe 7 pertaining to each of the scraper units 12; 112 runs through the bottom 14; 114 in a central portion of scraper unit 12; 112. More precisely, the pipe 7 ends within the associated scraper unit 12; 112, thereby defining a suction aperture 7A; 107A. In this context it should be noted that the respective ranges of action of the scraper units 12; 112, i.e. the circular region which each unit treats, overlap one another sideways.

As may be seen most clearly in FIGS. 1 and 3, a ring brush 20 which is vertical in the position of use is disposed on the underside of the plate 1. For the sake of clarity of the gathering units 3; 103 in FIG. 3, parts of the ring brush 20 are not depicted in FIG. 3. This ring brush 20 is provided with such suspension (not depicted) relative to the plate 1 that it is movable between two positions. In the one position, the free end of the ring brush 20 is at a lower level, whereas in a second position the free end of the ring brush 20 is at a higher level. This is similar to the ring brush of a conventional vacuum cleaner nozzle.

A supporting wheel 21 disposed on the underside of the plate 1 is situated in the region of one end of the plate 1. During forward movement of the nozzle according to the present invention on a running surface, the gathering units 3; 103 or the ring brush 20 and the supporting wheel 21 will alternatively abut against the running surface.

The belt pulleys 9 mounted on the rotatable pipes 7 are connected together by an endless drive belt 22 which also extends round a drive source 25 preferably comprising an electric motor disposed on the upper side of the plate 1. The traction of the drive belt 22 relative to the belt pulleys 9 causes the two outermost belt pulleys 9 to rotate in the same direction, while the middle belt disc 9 will rotate in the opposite direction. The same obviously applies accordingly to the gathering units 3; 103.

The following description of how the nozzle according to the embodiment of the present invention depicted in FIGS. 1-3 works starts with how it works on a soft floor, e.g. a carpet or a broadloom carpet. In this case, the ring brush 20 will be in a raised position. The active treatment of the soft floor is performed by the gathering units 3; 103 and more specifically by the scraper units 12; 112 belonging to the respective gathering units 3; 103. The free edges of the walls 13; 113 of the scraper units 12; 112 protrude somewhat beyond the front surfaces 4; 104 of the gathering units 3; 103 which face towards the floor. This means that the free edges of the scraper units 12; 112 treat the soft floor and disengage dust and other particles, after which the dust and particles are sucked into the channel-like scraper units 12; 112 and pass thereafter through the pipes 7 into the suction chamber 10. The material sucked up proceeds thereafter through the outlet pipe 11 in order to be dealt with further in a vacuum cleaner or wet vacuum cleaner. The fact that the scraper units 12; 112 comprise channels with open ends in the region of the periphery of the gathering units 3; 103 makes it easy for the disengaged dust/particles to be sucked into the channels and thereafter proceed in the manner described above.

When the nozzle according to FIGS. 1-3 is used on a so-called hard floor, e.g. linoleum flooring or a parquet floor, the ring brush 20 is caused to assume a lowered position whereby the ring brush 20 abuts against the floor, whereas the gathering units 3; 103 will be at some distance from the floor. This means that the nozzle will be supported by the ring brush 20 abutting against the floor in the region of its one end and by the supporting wheel 21 in the region of its other end. The dust and particles which happen to be within the ring brush 20 when the nozzle moves forward across a hard floor will be sucked up via the scraper units 12; 112 of the gathering units 3; 103 in a manner corresponding to that described above, i.e. the dust and particles being preferably sucked in through the open ends of the channel-like scraper units 12; 112 and up through the pipes 7. The fact that the gathering units 3; 103 rotate will cause them to treat the bulk of the surface situated within the ring brush 20. In this context it should be mentioned that the rounded transition of the gathering units 3; 103 makes it easier for the nozzle to move up from a hard floor onto a carpet lying on the hard floor.

Figure 4:
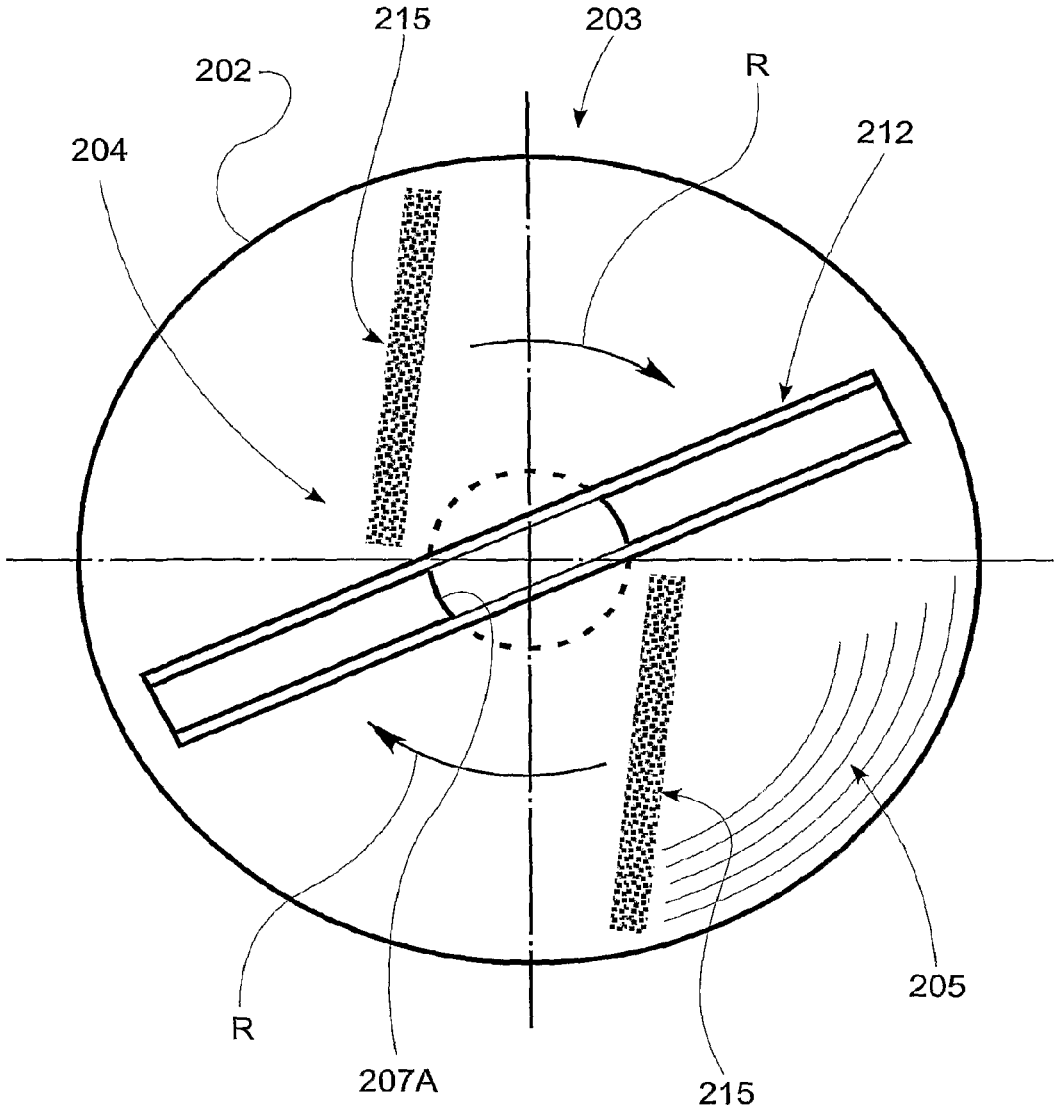
FIG. 4 depicts a plan view of an alternative embodiment of a gathering unit which forms part of the nozzle.

FIG. 4 depicts an alternative embodiment of a gathering unit 203, the basic form of which corresponds to the basic form of the gathering units 3; 103 described above. The gathering unit 203 likewise comprises a surface treatment element in the form of a scraper unit 212, which may be identical with the scraper unit 12. A pipe 207 leads into a central portion of the channel-like scraper unit 212, thereby defining a suction aperture 207A. The gathering unit 203 is also provided with two brushes 215 which in the embodiment depicted are straight. The brushes 215 are so oriented relative to the scraper unit 212 that they do not extend at right angles to scraper unit 212. The gathering unit 203 is thus provided both with a scraper unit 212 and with brushes 215.

Figure 5:
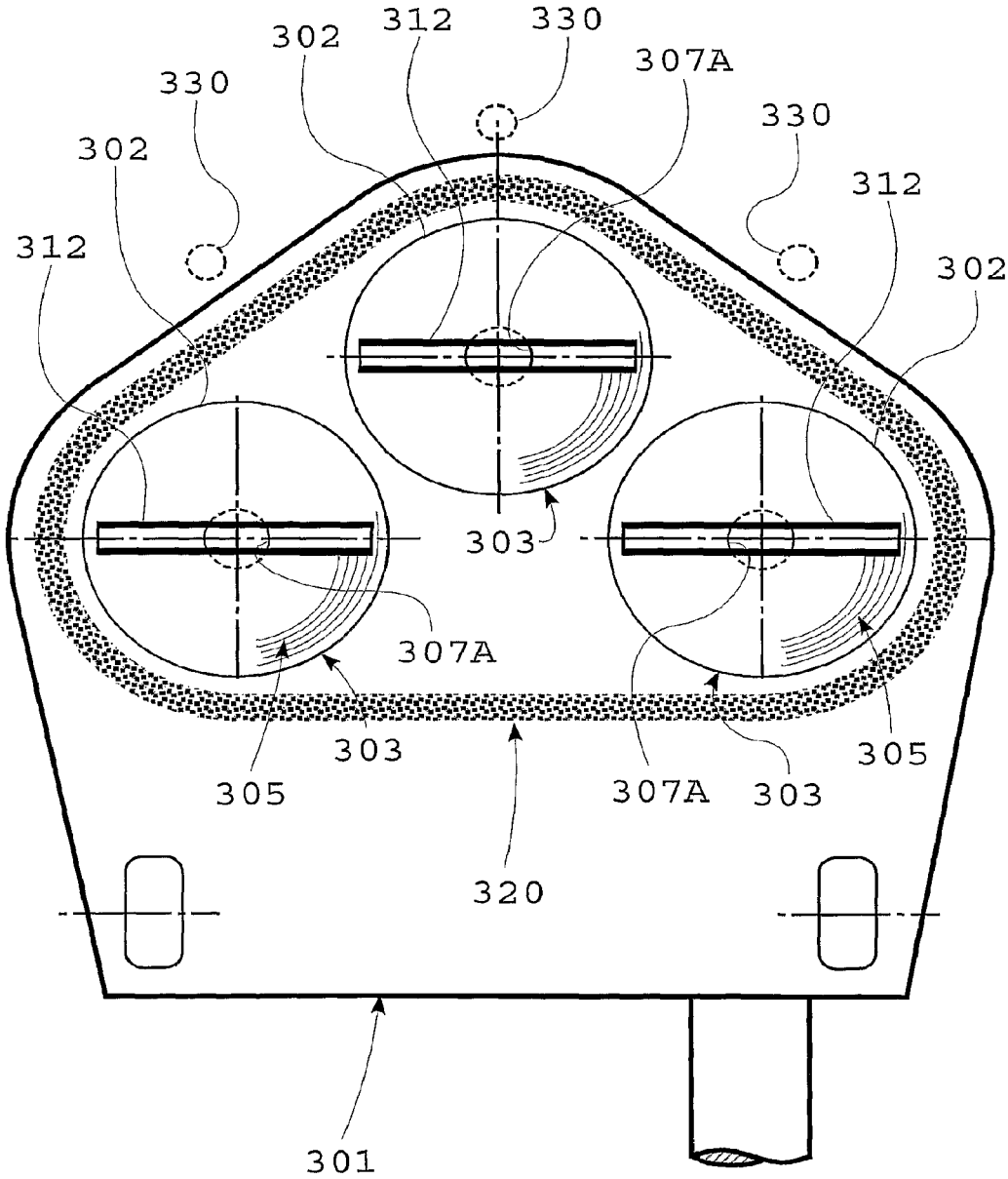
FIG. 5 depicts a plan view of the underside of an alternative embodiment of a nozzle according to the present invention.
Figure 6:
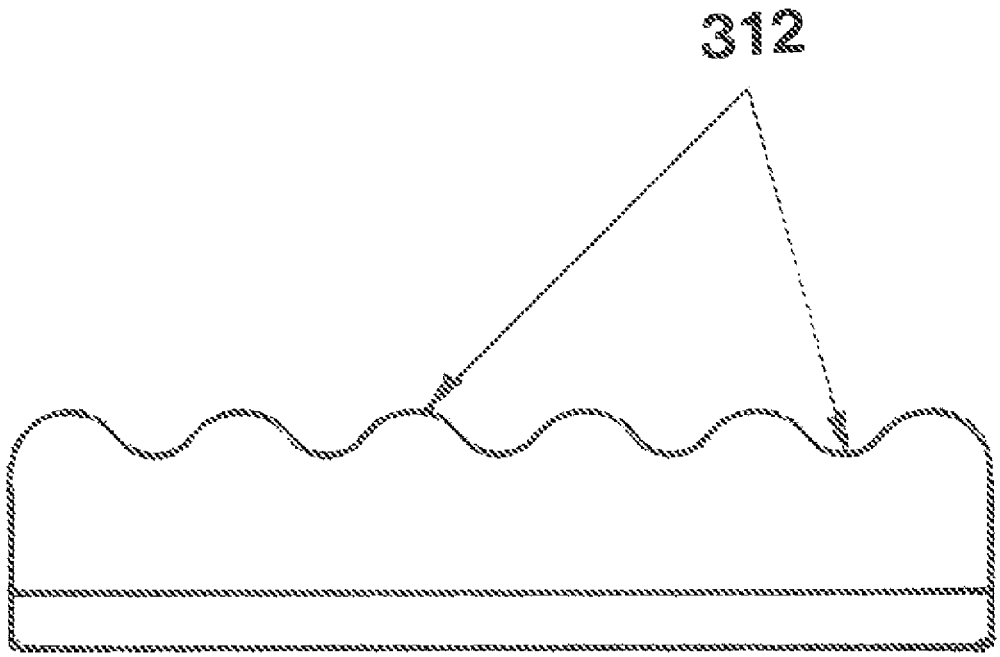
FIG. 6 schematically depicts one of the edges of the scraper units (312) which face towards the running surface being wavy.

The embodiment depicted in FIG. 5 of a nozzle according to the present invention likewise comprises three gathering units 303 which are in principle similar in configuration to the gathering units 3, i.e. each gathering unit is provided with a surface treatment element in the form of a scraper unit 312, with a suction aperture 307A disposed in the scraper unit 312. The gathering units 303 are mounted on a base 301 with mutual orientation similar to the nozzle according to FIGS. 1-3. The nozzle according to FIG. 5 is provided with a ring brush 320 capable of assuming a raised and a lowered position.

A substantial difference between the nozzle according to FIG. 5 and the nozzle according to FIGS. 1-3 is that the gathering units 303 are stationary, i.e. they are not rotatable. The nozzle according to FIG. 5 has no electric motor or belt pulleys and looks like an "ordinary" vacuum cleaner nozzle, but with a particular configuration and consequently special characteristics. As may be seen in FIG. 5, the scraper units 312 are parallel with one another and have an extent transverse to the nozzle's normal direction of movement. The scraper units 312 overlap one another sideways, i.e. when the nozzle according to FIG. 5 moves forward or backwards across the floor, the scraper units 312 will treat the whole of the surface across which the nozzle moves.

The nozzle according to FIG. 5 may be used on both soft floors and hard floors. On soft floors the scraper units 312 abut against the floor, whereas on hard floors the ring brush 320 abuts against the floor.

It is possible within the scope of the present invention that the nozzle according to FIG. 5 may have no ring brush.

Within the scope of the present invention it is possible for the nozzle according to FIG. 5 to be provided with supporting wheels at both of the ends which are situated in the nozzle's normal direction of movement. Such a configuration means that when the nozzle moves onto a hard running surface the scraper units will not be in contact with the running surface. When a nozzle of this kind moves onto a soft running surface, e.g. a carpet, the supporting wheels will sink into the running surface and the scraper units will abut against the running surface.

Within the scope of the present invention it is possible in the embodiment according to FIG. 5 for the edges of the mutually parallel walls of the scraper units which face towards the running surface to be wavy or undulating. In such cases it is possible for only one or both of the edges to be wavy. Wavy edges make it possible for air to pass between them and the running surface, which is desirable as regards the nozzle's ability to suck up particles from the running surface.

Conceivable Modifications of the Invention

Both the embodiment according to FIGS. 1-3 and the embodiment according to FIG. 5 may with certain modifications be used as nozzles for wet vacuum cleaners. In such cases the nozzles may be provided with supply lines for water in which cleaning agents are preferably added. Such supply lines are depicted schematically in the form of broken circles 30; 330 in FIG. 1 and FIG. 5 respectively.

In the embodiments referred to above of the nozzle according to the present invention, three gathering units are disposed on the base of the nozzle. Within the scope of the present invention it is nevertheless possible to conceive of the nozzle comprising both fewer and more gathering units than as referred to above. In such cases a single gathering unit is obviously the minimum number.

The invention claimed is:

1. A nozzle intended to be connected to a suction source, comprising:

at least one suction aperture (7A; 107A; 207A; 307A) which communicates with the suction source; and plural gathering units, each gathering unit (3; 103; 203; 303) disposed close to each suction aperture (7A; 107A; 207A; 307A), each gathering unit (3; 103; 203; 303) having i) a peripheral surface (2; 102; 202; 302), ii) a front surface (4; 104; 204; 304), which front surface faces towards a surface to be cleaned, and iii) a transition (5; 105; 205; 305) between the peripheral surface (2; 102; 202; 302) and the front surface (4; 104; 204; 304), when viewed in cross-section, the transition being rounded, each gathering unit (3; 103; 203; 303) provided with a surface treatment element in the form of a scraper unit (12; 112; 212; 312) which is open to the front surface facing towards the surface to be cleaned, and constitutes a surface treatment unit, the scraper unit (12) comprising a bottom element (14) connecting two opposite walls (13), the bottom element and two walls forming a U-shaped channel with opening at either end of the channel defined between the two walls and adjacent the bottom element, the front surface connecting to the two with free edges of the two walls protruding downwardly beyond the front surface an open side of the scraper unit (12; 112; 212; 312) is oriented along the front surface (4; 104; 204; 304) of the gathering unit (3; 103; 203; 303), each gathering unit, and being free of any brushes.

2. A nozzle according to claim 1, wherein, the gathering units (3; 103; 203) are supported for rotation in a base (1) of the nozzle, and the nozzle comprises means (9, 22, 25) for rotating the gathering units.

3. A nozzle according to claim 1, wherein, the gathering units (303) are stationary, and the scraper units (312) are parallel with one another.

4. A nozzle according to claim 1, wherein at least one scraper unit takes the form of plural intersecting channels.

5. A nozzle according to claim 1, wherein a ring brush (20; 320) surrounds all the gathering units (3; 103; 203; 303).

6. A nozzle according to claim 1, wherein there are plural suction apertures and the suction apertures (7A; 107A; 207A; 307A) communicate with the suction source via a suction chamber (10).

7. A nozzle according to claim 1, further comprising a supporting wheel (21).

8. A nozzle according to claim 1, further comprising two supporting wheels.

9. A nozzle according to claim 1, further comprising:

a base; and water supply lines (30; 330) located near the base;

wherein the nozzle is configured for a wet vacuum cleaner.

10. A nozzle according to claim 1, wherein the two walls of each scrapper unit have a constant height.

11. A nozzle intended to be connected to a suction source, comprising:

plural suction apertures (7A; 107A; 207A; 307A) in communication with the suction source; and plural gathering units (3; 103; 203; 303) disposed close to the suction apertures, each gathering unit having i) a peripheral surface, ii) a front surface facing towards a surface to be cleaned, and iii) a transition between the peripheral surface and the front surface, the transition, when viewed in cross-section, being rounded, each gathering unit provided a scraper unit having a bottom element, and two walls connected to each other by the bottom element, the two wall being parallel to each other, the bottom element and two walls, in cross section forming a U-shaped channel with openings at either end of the channel defined between the two walls and adjacent the bottom element the scraper unit defining a straight channel with open ends in a region of the periphery of each gathering unit with a bottom perimeter of the scraper unit being open at each of the open ends, the front surface connecting to the two walls, free edges of the two walls protruding downwardly beyond the front surface, the scraper unit constituting a surface treatment unit, and each gathering unit being free of any brushes.

12. A nozzle according to claim 11, further comprising:

a base (1) supporting the gathering units; and means (9, 22, 25) for rotating the gathering units.

13. A nozzle according to claim 11, wherein, the gathering units (303) are stationary, and each of the walls of the scraper units are parallel with all other ones of the rectilinear walls of the scraper units.

14. A nozzle according to claim 11, wherein at least one scraper unit comprises two sets of walls intersecting and defining intersecting plural channels.

15. A nozzle according to claim 11, further comprising a single ring brush (20) surrounding all the gathering units.

16. A nozzle according to claim 11, further comprising:

a base; and water supply lines (30; 330) located near the base;

wherein the nozzle is configured for a wet vacuum cleaner.

* * * * *